US005652577A

United States Patent [19]

Frasier

[11] Patent Number: 5,652,577

[45] Date of Patent: Jul. 29, 1997

[54] DEVICE AND METHOD FOR PASSIVELY ACTIVATING INDUCTIVE LOOP SENSOR

[75] Inventor: Lyman Harwood Frasier, Aurora, Colo.

[73] Assignee: Frasier Products, Inc., Denver, Colo.

[21] Appl. No.: 330,357

[22] Filed: Oct. 27, 1994

[51] Int. Cl.[6] ..... G08G 1/00

[52] U.S. Cl. ..... 340/933; 340/561; 340/939; 340/941; 324/236

[58] Field of Search ..... 340/561, 562, 340/941, 551, 553, 565, 567, 573, 933, 515, 939, 568; 324/233, 236

[56] References Cited

U.S. PATENT DOCUMENTS

| | | | |
|---|---|---|---|
| 3,462,692 | 8/1969 | Bartlett | 340/562 |
| 3,496,381 | 2/1970 | Wisnia | 340/562 |
| 3,571,666 | 3/1971 | Wagner | 340/562 |
| 3,693,144 | 9/1972 | Freidman . | |
| 3,764,819 | 10/1973 | Muller | 340/562 |
| 4,240,528 | 12/1980 | Kraus | 340/562 |
| 4,320,766 | 3/1982 | Alihanka et al. | 340/562 |
| 4,350,883 | 9/1982 | Lagarde | 340/561 |
| 4,430,636 | 2/1984 | Bruce . | |
| 4,430,645 | 2/1984 | Eskandry | 340/562 |
| 4,472,706 | 9/1984 | Hodge et al. . | |
| 4,529,982 | 7/1985 | Karlstrom et al. . | |
| 4,566,008 | 1/1986 | Powers et al. . | |
| 4,595,877 | 6/1986 | Dülk | 340/941 |
| 5,019,804 | 5/1991 | Fraden | 340/562 |
| 5,057,831 | 10/1991 | Strang et al. | 340/941 |
| 5,337,353 | 8/1994 | Boie et al. | 340/562 |

*Primary Examiner*—Jeffery Hofsass
*Assistant Examiner*—Edward Lefkowitz
*Attorney, Agent, or Firm*—Dorr, Carson, Sloan & Birney, P.C.

[57] ABSTRACT

A device and method for passively activating an inductive loop vehicle sensor. The sensor has an inductive loop in a roadway that produces an electro-magnetic field and utilizes the changes caused by the interaction of a detectable vehicle with the field to activate it. The device includes at least one metallic foil having sufficient area and thickness to cause changes sufficiently similar to changes caused by a detectable vehicle to activate the sensor when said foil is placed within the electro-magnetic field. The method includes providing such a device and deploying the device in a plane substantially parallel to the roadway and within the field of the loop.

20 Claims, 3 Drawing Sheets

Fig. 1(a)
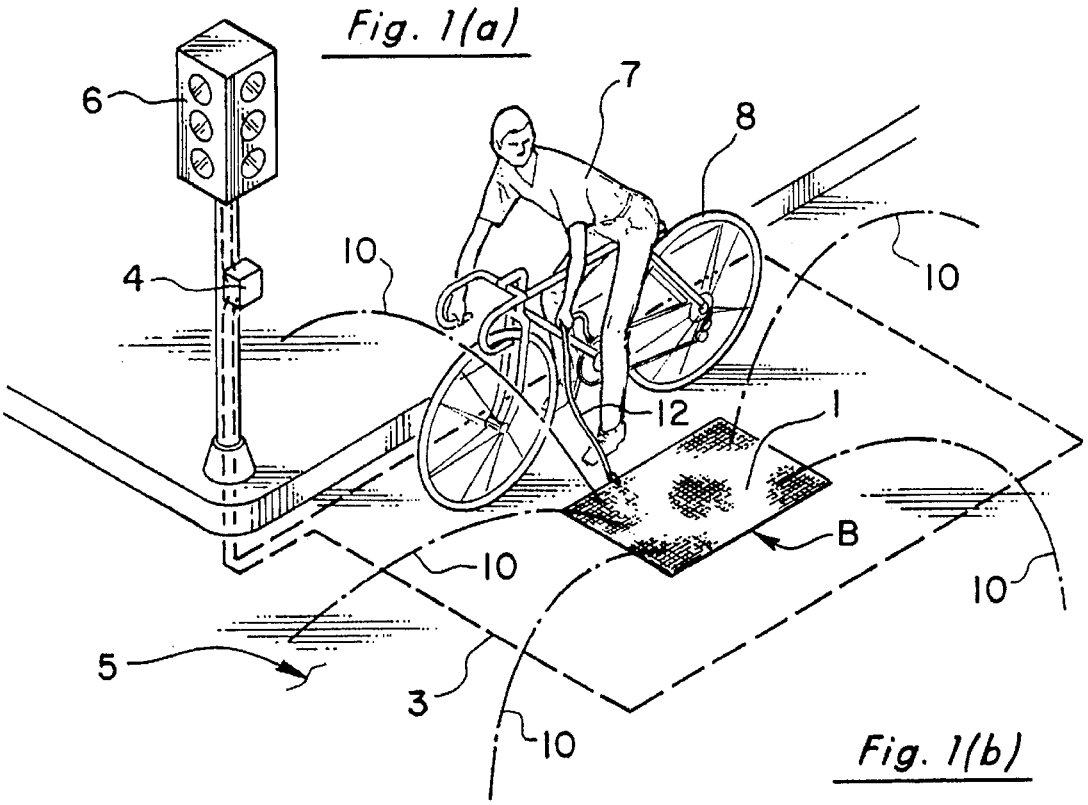
Fig. 1(b)
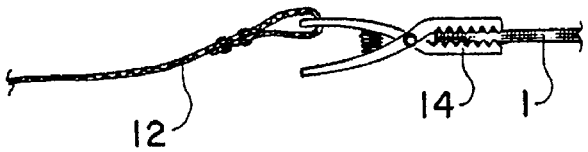
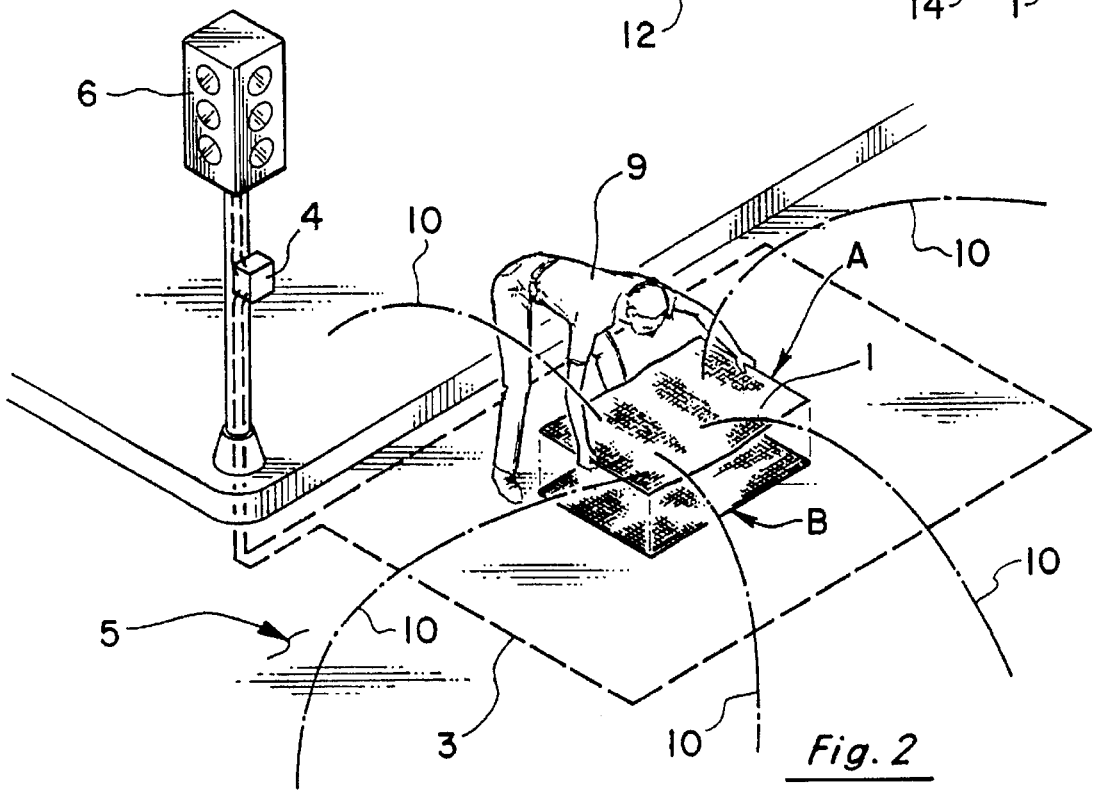
Fig. 2

Fig. 3
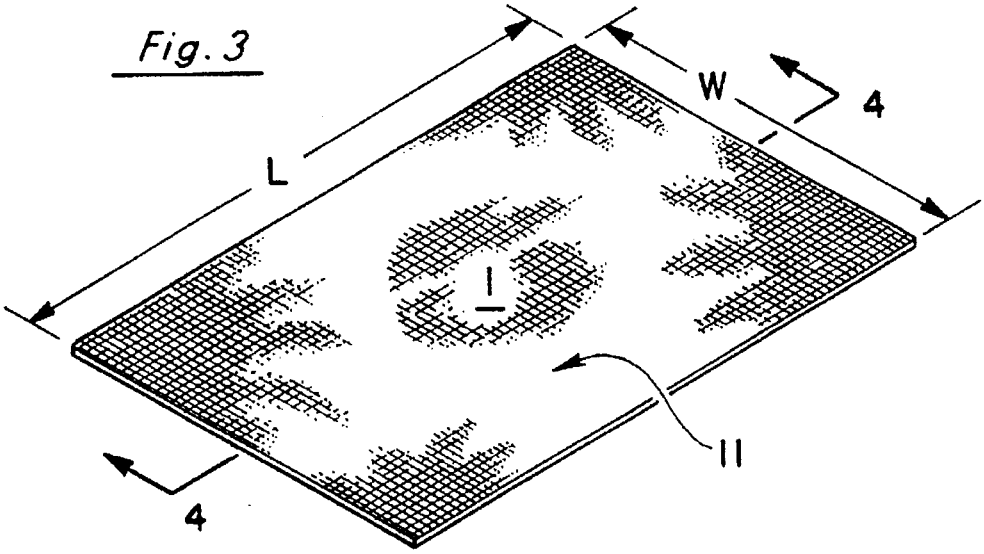
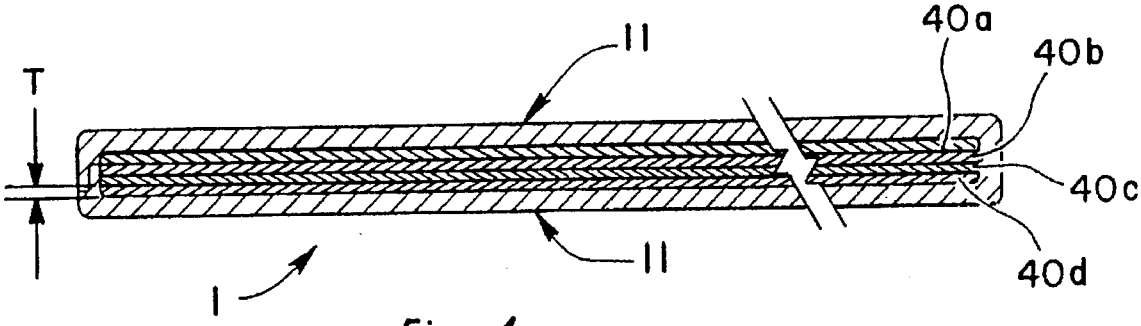
Fig. 4
Fig. 5
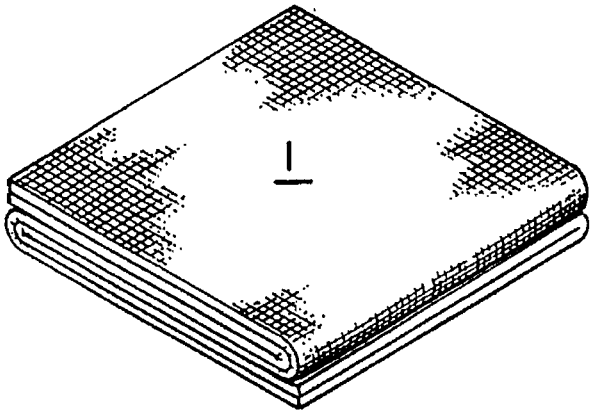
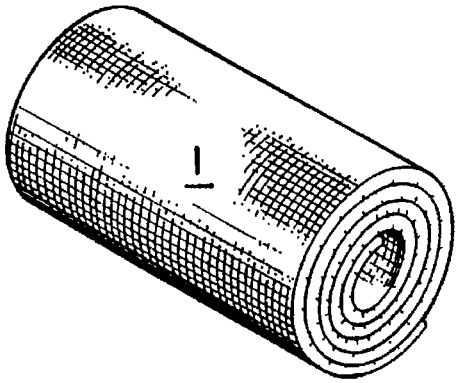
Fig. 6

Fig. 7(a)
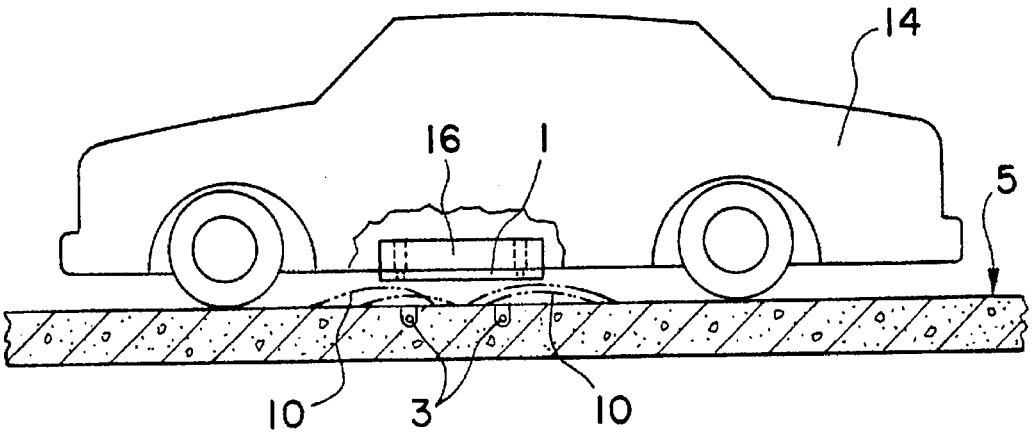
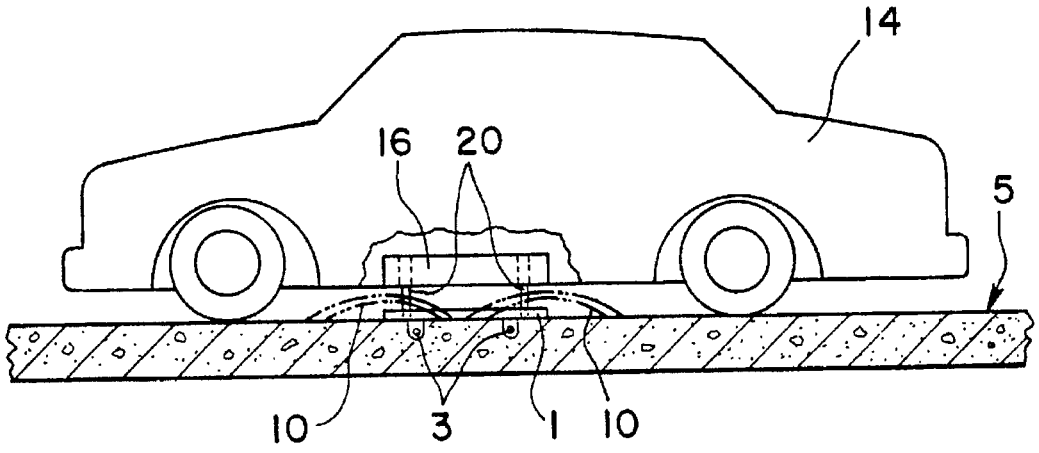
Fig. 7(b)

DEVICE AND METHOD FOR PASSIVELY ACTIVATING INDUCTIVE LOOP SENSOR

BACKGROUND OF THE INVENTION

1. Field of the Invention

This invention relates to the field of traffic control systems using an inductive loop in a roadway to detect the presence of a vehicle by sensing interactions of the vehicle with the electro-magnetic field of the loop. More specifically, this invention relates to the field of devices and methods to activate such traffic control systems by passively simulating the presence of a vehicle.

2. Discussion of the Background

Control systems for traffic signals typically include a vehicle sensor having an inductive loop and utilizing the interaction between the electromagnetic field of the loop and a vehicle. The prior art is replete with descriptions of such systems as represented by U.S. Pat. No. 4,430,636 to Bruce, U.S. Pat. No. 4,472,706 to Hodge et al., U.S. Pat. No. 4,566,008 to Powers et al., U.S. Pat. No. 4,529,982 to Karlstrom et al., and U.S. Pat. No. 3,693,144 to Freidman.

The inductive loop vehicle sensors used in roadways as described in the aforementioned prior art typically include means for creating an electro-magnetic field, usually an inductive loop in the roadway (either embedded in the roadway or attached to the surface of the roadway). The inductive loop produces the electro-magnetic field, and such sensors further include means for utilizing changes in the electro-magnetic field to activate the control system. For example, when a vehicle such as a conventional automobile enters the electro-magnetic field, the inductance of the loop changes, and the sensor utilizes these changes in the inductance to sense the presence of the automobile and to activate the system.

However, many modern automobile designs utilize composite materials to the extent that such automobiles lack sufficient metallic presence to be detected by such sensors. Metallic presence as used herein refers to the combination of metallic mass and surface area necessary to activate the sensor. Also, some large vehicles, such as trucks, sit too high above the roadway to sufficiently interact with the field. Many other vehicles lacking sufficient metallic presence, such as motorcycles, bicycles, and wheelchairs, also fail to activate such control systems. (For convenience and clarity, all such automobiles, trucks, and other vehicles are hereinafter referred to as "undetectable vehicles" because such vehicles cannot be detected by such sensors, either due to their lack of sufficient metallic presence or high ground clearance, or both. In contrast, those vehicles having sufficient metallic presence and appropriate ground clearance so as to be detected by such sensors are hereinafter referred to as "detectable vehicles".) Furthermore, pedestrians obviously cannot activate such sensors.

One attempted solution to this problem is disclosed in U.S. Pat. No. 5,057,831 to Strang et al. This approach utilizes an active electronic circuit to derive a signal from the electromagnetic field of the sensing loop, amplify it, and impress upon such field a re-radiated signal in a phase creating within the field a disturbance similar to that which would occur upon the presence of a detectable vehicle. However, the Strang simulator requires a large number of components, packaging for these components, as well as a power source, all adding to the complexity and manufacturing costs of this simulator.

Hence, the need exists for an activation device that is lightweight, highly portable, inexpensive, and easy to use, as well as a method to ensure detection by such sensors of otherwise undetectable vehicles and pedestrians to allow safe and unobstructed traffic flow.

SUMMARY OF THE INVENTION

The present invention provides a novel solution to the aforementioned problems and is lightweight, compact, of few components, inexpensive, and easy to use. Briefly stated, the preferred embodiment of the present invention includes a plurality of metallic foils in a superposed relation encased in a nylon canvas material and method for deploying it. The preferred embodiment of the activator is completely passive, having no active circuits. Additionally, it is constructed of inexpensive materials. Hence, the preferred embodiment provides a less complex and less costly solution than the active systems found in the prior art noted above.

The present invention simulates the presence of a detectable vehicle by interacting with the electro-magnetic field of the loop to cause changes in the inductance sufficiently similar to those changes caused by a detectable vehicle so as to activate the sensor. Where such sensors are used, for example, to control traffic signals, a pedestrian or an operator of a motorcycle, bicycle, or other undetectable vehicle can use this invention to activate such traffic signals.

Other uses, features, and advantages of the present invention will become apparent to those skilled in the art with reference to the detailed description, appended claims, and accompanying drawings.

BRIEF DESCRIPTION OF THE DRAWINGS

FIG. 1(*a*) is a perspective representation of an undetectable vehicle such as a bicycle on a roadway with the passive activator of the present invention deployed to interact with the electro-magnetic field of an inductive loop vehicle sensor.

FIG. 1(*b*) is a profile view of a lanyard and a spring-clip attached to the passive activator.

FIG. 2 is a perspective representation of a pedestrian deploying the passive activator according to the method of the preferred embodiment of the present invention. In this view, the passive activator is shown in its fully deployed position on the surface of the roadway and in interaction with the field of the inductive loop to activate the sensor.

FIG. 3 is a perspective view of the preferred embodiment of the passive activator shown in FIGS. 1–2.

FIG. 4 is an exaggerated sectional view taken along line 4—4 of FIG. 3.

FIG. 5 is a perspective view of the passive activator of FIGS. 1–4 shown in a folded state.

FIG. 6 is a perspective view of the passive activator of FIGS. 1–4 shown in a rolled state.

FIGS. 7(*a*) is a profile view of an undetectable vehicle with the passive activator attached thereto in an undeployed state.

FIG. 7(*b*) is a profile view of an undetectable vehicle with the passive activator attached thereto in a deployed state.

DETAILED DESCRIPTION OF THE PREFERRED EMBODIMENTS

The passive activator 1 as illustrated in FIGS. 1 and 2 is primarily intended to be used by an operator 7 of an undetectable vehicle such as a bicycle 8 (FIG. 2(*a*)) or by a pedestrian 9 (FIG. 2) to activate a conventional vehicle sensing arrangement. Such conventional arrangements typically include an inductive loop vehicle sensor, which includes means for creating an electro-magnetic field 10 such as an inductive loop 3 in a roadway 5, and means 4 for utilizing changes in the electro-magnetic field 10 to activate the vehicle sensing arrangement. In normal operation, the vehicle sensing arrangement, including loop 3 and means 4 for utilizing changes in the electro-magnetic field 10, senses detectable vehicles to control a traffic light 6. In doing so, the loop 3 generates an electro-magnetic field 10. The utilizing means 4 then senses changes in the inductance of the loop 3 due to the interaction of the electro-magnetic field 10 with a detectable vehicle, and upon sensing such changes, activates the vehicle sensing arrangement that, in this example, then activates the traffic light 6.

The size, orientation, and configuration of the loop 3 in FIGS. 1(*a*) and 2 are for illustration only, as the actual size, configuration, and orientation will vary according to the particular variety of inductive loop vehicle sensor and the particular application. Likewise, the orientations of the passive activator 1 shown in FIG. 1(*a*) and FIG. 2 are only examples of the many positions in which the passive activator 1 may be positioned to activate the inductive loop vehicle sensor (3 and 4) or the vehicle sensing arrangement (3 and 4).

The preferred embodiment of the passive activator shown in FIG. 3 has a width W (e.g., nineteen (19) inches) and a length L (e.g., thirty-one (31) inches) creating a predetermined area (e.g., five hundred eighty nine (589) square inches). The actual dimensions of the activator could obviously vary. Other embodiments having larger or smaller surface areas could also be employed as long as such embodiments are sufficiently sized to activate the particular vehicle sensing arrangement in the particular application in which the vehicle sensing arrangement is used. Further, while a rectangular shape has been described, it is to be understood that other shapes (e.g. circles, squares, ovals, etc.) could also be used.

The preferred embodiment as best seen in FIG. 4 has four superposed aluminum foils (40*a*, 40*b*, 40*c*, 40*d*, collectively referred to herein as 40) with each being about one thousandth (0.001) inch thick (as represented by dimension T in FIG. 4). The foils 40 are retained in the superposed relation by the encasing means 11 for the foils 40. In the preferred embodiment, the encasing means 11 is a cover of a canvas material made of nylon, although other nonmetallic compositions could be used. The nylon cover 11 encases the foils 40, thereby holding the foils 40 together in a superposed relation and protecting the thin foils 40 from damage. At this point, it is noted that the present invention includes those embodiments having a single foil, or any number of foils, with or without the cover 11. It is also to be understood that the present invention includes those embodiments using foil or foils of metals other than aluminum, and with a thickness greater than or less than one thousandth of an inch. Further, that the foils could be of a metallic mesh as well.

As discussed above, the passive activator 1 can be used by operators of undetectable vehicles such as bicycles and motorcycles as well as by pedestrians. While other configurations are possible, the preferred embodiment is primarily intended to be carried in a compact state such as a folded state as shown in FIG. 5 by the operator 7 of a bicycle 8 (FIG. 1(*a*)) or a pedestrian 9 (FIG. 2). In one variation of this embodiment, the passive activator 1 could be carried in a rolled state as shown in FIG. 6.

The preferred method for activating the inductive loop vehicle sensor in the roadway of FIGS. 1(*a*) and 2 is to provide the preferred embodiment of the passive activator 1 described above initially in a compact state such as a folded (FIG. 5), rolled (FIG. 6), or other nonplanar state for easy carrying. When needed to activate a sensor, the passive activator is first unfolded or unrolled by the operator 7 of the undetectable vehicle 8 or the pedestrian 9. Thereafter, the passive activator 1 is deployed in a substantially planar state and placed substantially parallel to the roadway 5 within the field 10 of the loop 3 and above the roadway 5 (see position A in FIG. 2). This position A, for example, could be about nine to twelve inches, although a distance less than nine inches or greater than twelve inches would also suffice though perhaps with less consistent results. It is well known that electro-magnetic fields propagate large distances. However, as used herein, "in" or "within" the electro-magnetic field 10 of the inductive loop 3 means within that effective range beyond which the inductive loop vehicle sensor or vehicle sensing arrangement cannot perceive the changes due to the interaction of the field 10 and the passive activator 1. Furthermore, "electro-magnetic field" as used herein includes both an electrical field and a magnetic field. Referring again to FIG. 2, once the passive activator i has been placed in the illustrated position A, the passive activator 1 is rapidly relocated to superposed contact with the roadway 5 at position B by dropping the passive activator 1, thereby activating the sensor. Once the sensor is activated, the operator 7 deploying the passive activator 1 can quickly retrieve the activator 1 from the roadway 5. This can be done in any number of ways including by pulling on the lanyard 12 in FIG. 1(*a*), which is attached to the cover 11 of the passive activator 1 by a simple spring-clip 14 (see FIG. 1(*b*)). While such a spring-clip is shown in FIG. 1(*b*), innumerable well known devices are obviously available for attaching the lanyard 12 to the passive activator 1.

While the preferred method for deploying the passive activator 1 has been described above, it is to be understood that other methods for deploying the passive activator 1 within the electro-magnetic field 10 of the loop 3 could be used to activate the vehicle sensing arrangement. For instance, holding the passive activator 1 above the loop 3 and within the electro-magnetic field 10 would also activate some particular vehicle sensing arrangements. Hence, the rapidly relocating, especially by dropping, of the passive activator 1 as described above is only the preferred method but not the only method.

It is also anticipated that the passive activator 1 could be used as part of a passive activation system (see FIGS. 7(*a*) and 7(*b*)) mounted to an undetectable vehicle such as an automobile 14 as shown in FIGS. 7(*a*) and 7(*b*). In this regard, FIG. 7(*a*) shows the undetectable automobile 14 with the passive activator 1 as described above. However, the passive activator in this environment need not include the cover 11, and could include just a single foil 40. In such a case, the foil 40 would preferably be of sufficient thickness (e.g. 0.125 inch thick aluminum plate) so as to have sufficient structural rigidity to be mounted to the rod or rods 20 and to survive under the undercarriage of the automobile 14 without being damaged. The passive activator 1 of the passive activation system of FIGS. 7(*a*) and 7(*b*) is attached to means 16 for selectively moving the passive activator 1 between an undeployed position (see FIG. 7(*a*)) in proximity to the automobile 14 and a deployed position in proximity to the roadway as shown in FIG. 7 (*b*).

The moving means 16 can be mounted to the automobile 14 by any number of conventional arrangements. Further, as shown in FIG. 7(*b*), the passive activator 1 can be attached to the moving means 16 by any number of arrangements including one or more of the illustrated rods 20. In the preferred embodiment of this passive activation system, the moving means 16 utilizes two fluidic actuators (e.g. such as hydraulic or pneumatic cylinders) to cause linear movement of the rods 20. In another contemplated embodiment, the moving means 16 would utilize at least one or more electric motors to cause the linear movement of the rods 20. Combinations of one or more rods 20, and one or more fluidic actuators or electric motors could also be used. In yet another embodiment of the passive activation system, the passive activator 1 (including one or more thin foils 40) would simply be attached to a thicker supporting member. The thicker supporting member would then provide rigidity to hold the passive activator 1 in a substantially planar state, with both of them being attached to at least one rod 20.

In use, an operator of the undetectable automobile 14 would activate (e.g., a control switch mounted near the dash) the moving means 16 to move the foil from a raised position in proximity to the automobile 14 (as shown in FIG. 7(*a*)) to a lowered position in proximity to the roadway and within the electro-magnetic field 10 of the loop 3 (as shown in FIG. 7(*b*)). For best results, the passive activator 1 would be lowered to actually contact the surface of the roadway 5, as shown in FIG. 7(*b*). In many cases, only partial lowering to some position above the roadway 5 but not contacting the roadway 5 would be sufficient to activate the vehicle sensing arrangement. Further, in some instances, the mere presence of the passive activator 1 in the undeployed position shown in FIG. 7(*a*) would suffice to activate some vehicle sensing arrangements that the automobile 14 alone could not activate. In other words, once the activator 1 is selectively lowered to activate the vehicle sensing arrangement described above and as shown in FIGS. 7(*a*) and 7(*b*), the operator can operate the moving means 16 to raise the passive activator 1 from the position in proximity to the roadway 5 shown FIG. 7(*b*) to the position in proximity to the automobile 14 shown in FIG. 7(*a*).

Thus, the present invention includes a device and method primarily intended to be used in combination with a vehicle sensing arrangement, such as an inductive loop vehicle sensor, in a roadway 5. The vehicle sensing arrangement includes means 3 for creating an electro-magnetic field 10 and means 4 for utilizing changes in the electro-magnetic field 10 (e.g, either in the electric or magnetic components thereof, or in both) caused by the presence of a detectable vehicle in the field 10 to activate the vehicle sensing arrangement. To simulate the presence of a detectable vehicle to activate the vehicle sensing arrangement, the passive activator 1 of the present invention can then be deployed in the electro-magnetic field 10.

While several embodiments of the present invention have been shown and described in detail, it is to be understood that various changes and modifications could be made without departing from the scope of the invention. For example, a single thicker foil (e.g., four thousandths (0.004) of an inch) could be substituted for the four foils 40. Also, the nylon cover 11 is not essential to the operation of the passive activator 1 and could be eliminated (although another means for holding the foils 40 in a superposed relation would be desired as the foils 40 without a cover 11 would be more susceptible to damage). Furthermore, many other materials could be used for the cover 11, such as a flexible plastic or synthetic resin, or a woven or nonwoven material constructed of a natural fiber such as cotton, or a synthetic fiber other than nylon, or a composite material of natural and synthetic fibers.

It is also anticipated that the passive activator 1 could be deployed using an umbrella-type mechanism. In doing so, the operator 7 of the undetectable vehicle or the pedestrian 9 would deploy the passive activator 1 according to the method of this invention by simply opening an umbrella-like device with the cloth of a conventional umbrella replaced or augmented with the foil or foils 40 as described herein. Other contemplated embodiments include devices having mechanisms serving to deploy the passive activator 1 from a compact state such as folded, rolled, or other nonplanar state to a substantially planar state, such devices being fully automated or requiring human manipulation as the umbrella-like device described above.

Accordingly, these and other like modifications and uses of the described device and method for passively activating an inductive loop sensor are within the spirit and claims of the present invention.

I claim:

1. A passive activator for use by a user in combination with a vehicle sensing arrangement in a roadway, said vehicle sensing arrangement including an inductive loop for creating an electro-magnetic field and means for utilizing changes in said electro-magnetic field caused by the presence of a detectable vehicle in said electro-magnetic field to activate said sensing arrangement, said passive activator comprising:

at least one lightweight, thin metallic foil, said at least one metallic foil stored in a compacted state when carried by said user, said at least one metallic foil having a predetermined area to produce changes in said electro-magnetic field similar to said changes caused by said detectable vehicle to thereby activate said sensing arrangement when said passive activator is deployed by said user from said compacted state to a substantially planar orientation within said electro-magnetic field substantially parallel to and above said roadway.

2. The passive activator of claim 1 further including means for encasing said foil.

3. A passive activator for activating an inductive loop vehicle sensor in a roadway, said inductive loop vehicle sensor having an inductive loop producing an electro-magnetic field and means for utilizing changes in the inductance of the loop to activate the vehicle sensor, said changes in inductance occurring when the electro-magnetic field of the loop interacts with a detectable vehicle, said passive activator comprising:

a plurality of lightweight, thin metallic foils in a superposed relationship, said plurality of metallic foils stored in a compacted state when carried, said plurality of metallic foils having a predetermined area to produce changes in the inductance of the loop similar to said changes caused by the detectable vehicle, said metallic foils activating the inductive loop vehicle sensor when said plurality of metallic foils is deployed from said compacted state to a substantially planar orientation within the electro-magnetic field substantially parallel to and above said roadway.

4. The passive activator of claim 3 wherein the foils are arranged in a superposed relation.

5. The passive activator of claim 4 further including means for encasing the plurality of foils.

6. The passive activator of claim 5 wherein the encasing means is of a nonmetallic composition.

7. The passive activator of claim 6 wherein the encasing means is made of nylon.

8. A passive activator for use in combination with a vehicle sensing arrangement in a roadway, said sensing arrangement including an inductive loop for creating an electro-magnetic field and means for utilizing changes in said electro-magnetic field caused by the presence of a detectable vehicle in said electro-magnetic field to activate said vehicle sensing arrangement, said passive activator being deployed within said electro-magnetic field to simulate the presence of said detectable vehicle to activate said sensing arrangement, said passive activator including:

a plurality of lightweight, metallic foils of predetermined area and thickness positioned in a superposed relation, the plurality of metallic foils having sufficient area and thickness to cause changes in the electro-magnetic field similar to said changes caused by the presence of said detectable vehicle to activate the sensing arrangement when said metallic foils are placed in a substantially planar orientation within said electro-magnetic field substantially parallel to and above said roadway, and means for encasing the plurality of metallic foils, said encasing means being of a nonmetallic composition.

9. A passive activation system for use on an undetectable vehicle and in combination with a vehicle sensing arrangement in a roadway, said vehicle sensing arrangement including an inductive loop for creating an electro-magnetic field and means for utilizing changes in said electro-magnetic field caused by the presence of a detectable vehicle in said electro-magnetic field to activate said sensing arrangement, said passive activation system comprising:

at least one lightweight, metallic foil having a predetermined area and thickness to produce changes in said electro-magnetic field similar to said changes caused by said detectable vehicle to thereby activate said sensing arrangement, a mount, said at least one lightweight, metallic foil connected to said mount on the underside of said undetectable vehicle, said undetectable vehicle moving said at least one metallic foil into said field of the loop so that said undetectable vehicle is detected when said undetectable vehicle is moved over said loop by said user.

10. The passive activation system of clam 9 wherein said mount comprises at least one fluidic actuator to move said lightweight, metallic foil from an undeployed position to a deployed position over said loop when said undetectable vehicle is over said loop.

11. The passive activation system of claim 9 wherein said mount comprises at least one electric motor to move said lightweight, metallic foil from an undeployed position to a deployed position over said loop when said undetectable vehicle is over said loop.

12. A passive activation system for use on an undetectable vehicle and in combination with a vehicle sensing arrangement in a roadway, said vehicle sensing arrangement including an inductive loop for creating an electro-magnetic field and means for utilizing changes in said electro-magnetic field caused by the presence of a detectable vehicle in said electro-magnetic field to activate said sensing arrangement, said passive activation system comprising:

at least one lightweight, metallic foil having a predetermined area and thickness to produce changes in said electro-magnetic field similar to said changes caused by said detectable vehicle to thereby activate said sensing arrangement, means mounted on said undetectable vehicle for selectively moving said at least one metallic foil between an undeployed state in proximity to said undetectable vehicle and a deployed state in proximity to the roadway and within said field of the loop, wherein the moving means further includes at least one rod member having a first end and a second end with the first end being attached to said foil, and said moving means further includes at least one fluidic actuator means for causing linear movement of said rod, said fluidic actuator means including a fluid under pressure.

13. A method for activating an inductive loop vehicle sensor in a roadway by a user operating an undetectable vehicle, the vehicle sensor having an inductive loop producing an electro-magnetic field and means for utilizing changes in the inductance of the loop occurring when the electro-magnetic field of the loop interacts with a detectable vehicle to activate the vehicle sensor, the method comprising the steps of:

(a) providing at least one lightweight, metallic foil in a substantially planar state, said at least one metallic foil having a predetermined area and thickness to produce changes in the inductance of the loop similar to the changes caused by the presence of said detectable vehicle in said field to activate the vehicle sensor, and (b) said user moving said undetectable vehicle over said loop, thereby positioning said foil in a plane substantially parallel to and above the roadway and within the electro-magnetic field of the loop to activate said vehicle sensor.

14. A method for activating an inductive loop vehicle sensor in a roadway by a user operating an undetectable vehicle, the vehicle sensor having an inductive loop producing a electro-magnetic field and means for utilizing changes in the inductance of the loop occurring when the electro-magnetic field of the loop interacts with a detectable vehicle to activate the vehicle sensor, the method including the steps of:

(a) providing at least one lightweight, metallic foil of predetermined area and thickness, (b) orienting said foil in a substantially planar orientation, on the underside of the undetectable vehicle and (c) said user moving said undetectable vehicle over said loop to position said oriented foil substantially parallel to and above the roadway and within the field of the loop to activate said vehicle sensor.

15. A method for activating an inductive loop vehicle sensor in a roadway, the vehicle sensor having an inductive loop producing a electro-magnetic field and means for utilizing changes in the inductance of the loop occurring when the electro-magnetic field of the loop interacts with a detectable vehicle to activate the vehicle sensor, the method including the steps of:

(a) providing at least one lightweight, metallic foil of predetermined area and thickness, (b) deploying said foil in a substantially planar orientation, and (c) placing the deployed foil substantially parallel to and above the roadway and within the field of the loop to activate said vehicle sensor wherein step (c) further includes first placing said foil parallel to and about nine to twelve inches above the roadway and then rapidly relocating said foil to superposed contact with the roadway.

16. The method of claim 15 wherein the step of rapidly relocating said foil to superposed contact with the roadway is accomplished by dropping the foil from said position of about nine to twelve inches above the roadway.

17. A method primarily intended for activating an inductive loop vehicle sensor in a roadway, the vehicle sensor having an inductive loop producing an electro-magnetic field and utilizing changes in the inductance of the loop occurring when the electro-magnetic field of the loop interacts with a detectable vehicle to activate said vehicle sensor, the method including the steps of:

(a) providing at least one metallic foil of predetermined area and thickness in a compact state, (b) deploying said foil from the compact state to a substantially planar state, and (c) placing the deployed foil in superposed contact with the roadway and within the field of the loop to activate said vehicle sensor.

18. The method of claim 17 further including retrieving the deployed foil from said superposed contact with the roadway after step (c).

19. The method of claim 17 wherein step (b) further includes positioning said foil about nine to twelve inches above the roadway and step (c) further includes rapidly relocating said foil as deployed in step (b) to superposed contact with the roadway and within the field of the loop.

20. The method of claim 19 wherein the rapidly relocating of said foil includes dropping said foil.

* * * * *